US009945207B2

(12) United States Patent
Bao et al.

(10) Patent No.: US 9,945,207 B2
(45) Date of Patent: Apr. 17, 2018

(54) MULTI-PATH MULTI-STAGE EROSION-RESISTANT VALVE FOR DOWNHOLE FLOW CONTROL

(71) Applicant: CALIFORNIA INSTITUTE OF TECHNOLOGY, Pasadena, CA (US)

(72) Inventors: Xiaoqi Bao, San Gabriel, CA (US); Mircea Badescu, La Canada Flintridge, CA (US); Stewart Sherrit, La Crescenta, CA (US); Jeffery L. Hall, South Pasadena, CA (US); Yoseph Bar-Cohen, Seal Beach, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 378 days.

(21) Appl. No.: 14/174,575

(22) Filed: Feb. 6, 2014

(65) Prior Publication Data

US 2014/0224342 A1 Aug. 14, 2014

Related U.S. Application Data

(60) Provisional application No. 61/763,357, filed on Feb. 11, 2013.

(51) Int. Cl.
*E21B 34/10* (2006.01)

(52) U.S. Cl.
CPC ..... *E21B 34/10* (2013.01); *Y10T 137/0368* (2015.04); *Y10T 137/7738* (2015.04)

(58) Field of Classification Search
CPC ..... E21B 34/06; E21B 34/10; E21B 43/12; E21B 43/14; Y10T 137/0368; Y10T 137/7738; F04D 13/10
USPC ..... 137/601.01, 601.12, 601.15
See application file for complete search history.

(56) References Cited

U.S. PATENT DOCUMENTS

| | | | | |
|---|---|---|---|---|
| 4,343,151 | A * | 8/1982 | Lorimor | B62D 5/07 60/422 |
| 5,176,164 | A * | 1/1993 | Boyle | E21B 34/06 137/155 |
| 5,927,326 | A * | 7/1999 | Hiejima | A61M 5/141 137/599.11 |
| 6,860,330 | B2 | 3/2005 | Jackson | |
| 7,942,206 | B2 * | 5/2011 | Huang | E21B 34/08 166/227 |

(Continued)

OTHER PUBLICATIONS

Accessed the meaning of plurality with the free dictionary on Apr. 29, 2016 via http://www.thefreedictionary.com/.*

(Continued)

*Primary Examiner* — Taras B Bemko
*Assistant Examiner* — Manuel C Portocarrero
(74) *Attorney, Agent, or Firm* — Steinfl + Bruno LLP

(57) ABSTRACT

A flow control valve for use in oil well bore holes. The flow control valve includes a plurality of flow paths connected in parallel. The flow control valve operates by successively opening different flow paths, starting with a flow path that requires a reduced force to operate its inlet valve. The flow rate through the flow control valve is controlled by opening and closing different ones of the plurality of flow paths individually or in combination. A flow path that allows fluid to flow at substantially the full flow rate of the valve is provided as one of the parallel paths. A simple mechanical design using poppet valves and at least one cam is described.

25 Claims, 12 Drawing Sheets

(56) References Cited

U.S. PATENT DOCUMENTS

2010/0090149 A1* 4/2010 Thompson ..... F04B 39/1013
251/321

OTHER PUBLICATIONS

Accessed the Bernoulli Equatin on Apr. 30, 2016 with University of Chicago via http://geosci.uchicago.edu/~moyer/GEOS24705/Notes/Bernoulli.pdf.*
Darcy's Law definition. Accessed on Sep. 15, 2016 via https://bae.okstate.edu/faculty-sites/Darcy/LaLoi/Basics.htm.*
Haugen K., O. Kvemvold, A. Ronold, R. Sandberg (1995), "Sand erosion of wear-resistant materials: Erosion in choke valves", Wear 186-187, pp. 179-188.

* cited by examiner

MULTI-PATH MULTI-STAGE EROSION-RESISTANT VALVE FOR DOWNHOLE FLOW CONTROL

CROSS-REFERENCE TO RELATED APPLICATIONS

This application claims priority to and the benefit of U.S. provisional patent application Ser. No. 61/763,357, filed Feb. 11, 2013, which application is incorporated herein by reference in its entirety.

STATEMENT REGARDING FEDERALLY FUNDED RESEARCH OR DEVELOPMENT

The invention described herein was made in the performance of work under a NASA contract, and is subject to the provisions of Public Law 96-517 (35 USC 202) in which the Contractor has elected to retain title.

FIELD OF THE INVENTION

The invention relates to systems and methods for control of fluid flow in general and particularly to systems and methods for controlling the flow of fluids in oil production.

BACKGROUND OF THE INVENTION

Choke valves for use in the downhole environment of oil wells are well known. However it is difficult to design and construct choke valves that fit within the restricted available space, that operate using limited power and that have long operational lifetimes. These choke valves must control the flow rate from high pressure oil reservoirs in the presence of fluids that contain abrasive particulate material such as sand, possibly in significant concentrations.

Also known in the prior art is Jackson, U.S. Pat. No. 6,860,330, issued Mar. 1, 2005, which is said to disclose a choke valve assembly for controlling the flow of fluid through a production tubing. The valve assembly includes a housing having a plurality of axially aligned apertures and a ported sleeve disposed in the housing. The ported sleeve has a plurality of rows of fluid ports. Each row of ports has at least one port in selective fluid communication with a respective aperture. In the full open position, each aperture is in fluid communication with a port from each row. To choke the flow, the ported sleeve is rotated relative to the housing to reduce the number of ports in fluid communication with the housing. To close the valve, axial force is applied to move the ported sleeve axially relative to the housing.

There is a need for improved valves for control of flow in oil production.

SUMMARY OF THE INVENTION

According to one aspect, the invention features a flow control valve. The flow control valve comprises a plurality M of flow paths connected in parallel, where M is an integer greater than one, each of the plurality M of flow paths connected in parallel having a fluid connection at one end to an inlet and having a fluid connection at a second end to an outlet; each of the plurality M of flow paths connected in parallel each having at least one poppet valve; each of the plurality M of flow paths connected in parallel having a respective plurality $N_I$ of stages, each stage comprising an orifice and a chamber, where $N_I$ is an integer that is greater than zero that describes the number of stages in a selected path I of the M paths; and at least one actuator operatively connected to at least one of the poppet valves, the at least one actuator operable to place the at least one of the poppet valves in one of a fully open state and a fully closed state; the flow control valve operable to permit a controlled flow of a fluid therethrough.

In one embodiment, the chamber of a last stage is the outlet.

In one embodiment, the plurality M of flow paths connected in parallel fit within an annular cylinder between an inner pipe and a casing pipe of an oil well.

In another embodiment, the flow control valve is operable to provide a flow having a flow rate determined according to a progression of the fully open and the fully closed states of the poppet valves of the plurality M of flow paths connected in parallel.

In yet another embodiment, the at least one actuator is an annular cam.

In still another embodiment, the at least one actuator comprises a plurality of annular cams.

In still another embodiment, the at least one actuator is a motor.

In a further embodiment, a first of the respective poppets has a mechanical interference with a second of the respective poppets, the mechanical interference when engaged communicating a drive force from the at least one actuator to the second of the respective poppets by way of the first of the respective poppets.

In yet a further embodiment, a sealing area between the cap and the orifice is located on the outside surface of the orifice or on the base of the orifice.

In a further embodiment, the controlled flow is determined by a state in which only one of the plurality M of flow paths connected in parallel is open.

In yet a further embodiment, the controlled flow is determined by a state in which at least two of the plurality M of flow paths connected in parallel are open.

In another embodiment, the at least one poppet valve is sized in proportion to a respective flow capacity of the path.

According to another aspect, the invention relates to a method of controlling a flow rate of a fluid. The method comprises the steps of: providing an flow control valve comprising an inlet for receiving a fluid and an outlet for delivering the fluid; and a plurality M of flow paths connected in parallel, where M is an integer greater than one, each of the plurality M of flow paths connected in parallel having a fluid connection at one end to the inlet and having a fluid connection at a second end to the outlet; one of the plurality M of flow paths connected in parallel having a flow capacity when open of substantially the total flow that the valve can provide, and each of the remaining M−1 flow paths connected in parallel having a respective flow capacity when open of a fractional part of the total flow that the valve can provide; each of the plurality M of flow paths connected in parallel each having a poppet valve sized in proportion to the respective flow capacity of the path; M−1 of the plurality M of flow paths connected in parallel each having a respective plurality of stages, each stage comprising an orifice and a chamber, the stages constructed to reduce a pressure of a fluid lowing through the respective one of the plurality M of flow paths connected in parallel; and at least one actuator operatively connected to at least one of the poppet valves, the at least one actuator operable to place the at least one of the poppet valves in one of a fully open state and a fully closed state; connecting the inlet of the flow control valve to a reservoir of fluid at a pressure P+ΔP; connecting the outlet of the flow control valve to a reservoir to receive fluid passing through the flow control valve; and operating the at least one actuator to open one or more of the poppet valves of the plurality M of flow paths connected in parallel so as to cause a flow of the fluid at a predetermined flow rate.

In one embodiment, the reservoir of fluid at the pressure P+ΔP is a production zone of an oil well.

In another embodiment, the flow of the fluid at the predetermined flow rate results in a pressure P at the outlet.

In yet another embodiment, the flow of the fluid in one path of the plurality M of flow paths connected in parallel has a the maximum flow velocity V given by $V=(2\Delta P/N_I\rho)^{0.5}$ where ΔP is the pressure drop between the inlet and the outlet, $N_I$ is an integer that is greater than zero that describes the number of stages in a selected open path I of the M paths, and ρ is the density of the fluid of the flow.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

Figure 1:
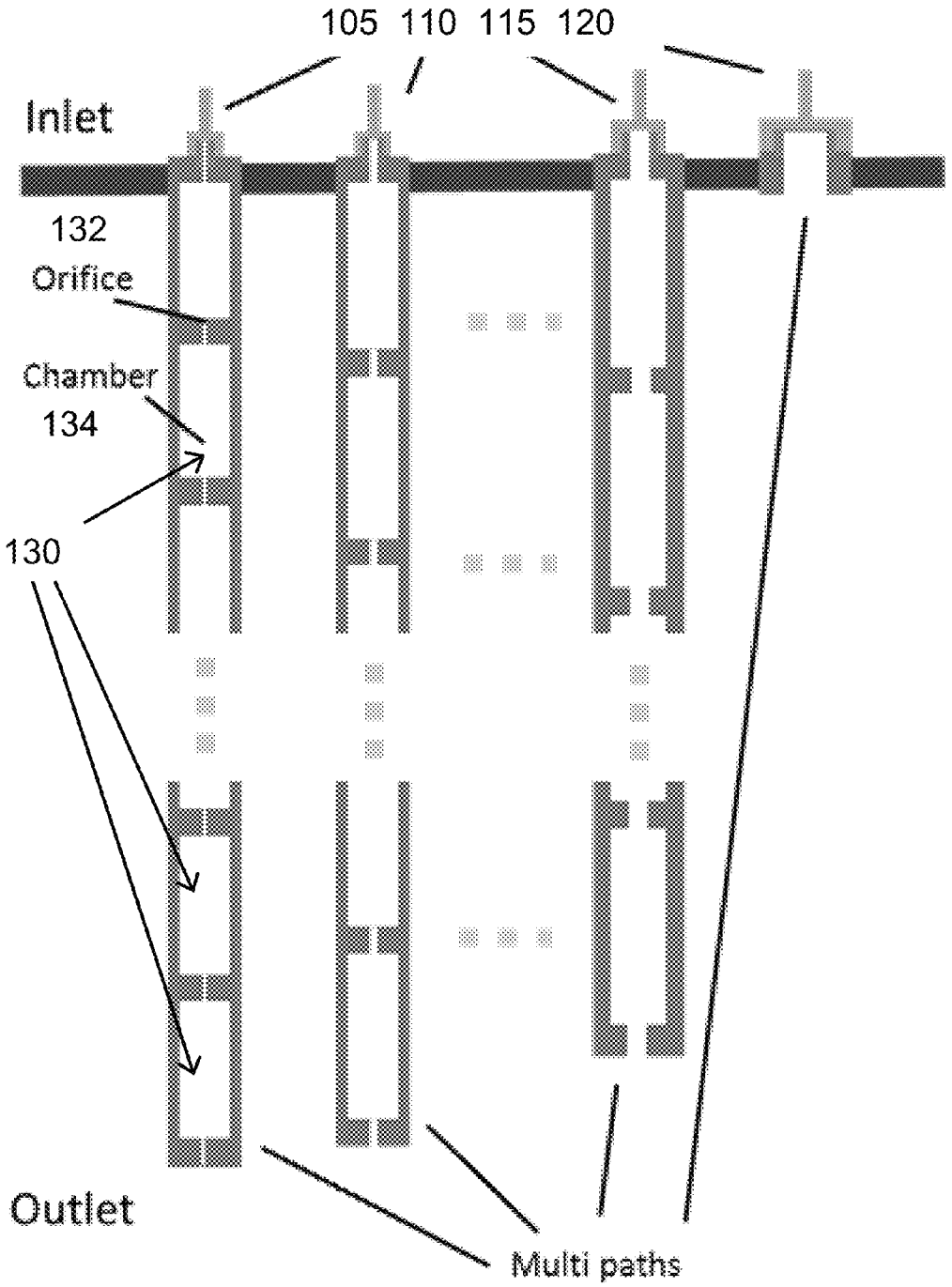
FIG. 1 is a schematic diagram of a multi-path multi-stage flow control valve for an oil well downhole application.

We describe a novel design of a downhole choke valve for high pressure, high flow rate control of oil wells. The valve comprises multipath, multistage pressure reduction structures and high erosion tolerance cap valves that are expected to provide long lifetime even with particulate-laden flow, for example oil mixed with sand or other particulate material. The valve controls the flow rate in a way that minimizes the actuation force. The valve operates using binary states (each valve is either open or closed) so that the flow rate can be controlled in what is a form of digital control. The valve can be activated by a single actuator or multiple actuators, under low power and is able to be fabricated to fit within the small space available in a downhole oil well.

The disclosed multipath multistage valve is designed to control flow from an individual production zone located downhole in an oil well. In general, it can be used in applications where high pressure flow control is needed.

The novel features of the valve system and method presented in this disclosure are believed to be:

1. A valve comprising multipath, multistage pressure reduction structures. Each path is controlled separately in an on/off fashion, resulting in a type of digital flow rate control for the entire flow.
2. The number of stages of pressure drop on each path is selected to limit the maximum flow speed to an acceptably low value to minimize erosion from entrained particulates.
3. The digital control of the flow rate allows for reduced actuation force under high pressure.
4. The system employs a poppet cap valve with high erosion tolerance for long lifetime in the presence of sand laden fluids.
5. The system provides a long and thin multistage pressure reduction structure that controls the flow speed, withstands high pressure, and fits in the available downhole space.

The Problem

As previously alluded to, oil produced from wells involves the control of fluids at high pressures, which fluids often contain abrasive particulate matter. The interaction of the particulate matter with the components of valves can cause erosion of the surfaces of the valve components, which leads to poor flow control and ultimately, failure of the valves. In particular as the flow rate of the fluid increases, the more destructive will be the action of the abrasive particulates on the valves.

Additional difficulties that can be encountered include the small space in which the valve must be operable, the need to deal with high pressures when opening valves, the issues related to exerting sufficient control on the fluid flow rate, and the need for the valve to be operated using limited amounts of power.

The novel design concept of digitalized flow control valve with multipath and multistage pressure reduction structures was developed to address these challenges.

The Solution

The design presented in various embodiments comprises a digital flow control valve having multipath and multistage pressure reduction structures. The valve includes a set of flow paths connected in parallel from the inlet to the outlet. The choke valve controls the total flow rate by opening different individual paths or different combinations of the paths in a binary (on or off) manner. The various paths are designed to have different individual flow rates, as will be explained, so that a progression of sequential path operations can control a flow in a manner analogous to digital control.

By way of example, it is known in digital systems that one can uniquely represent any integer value from 0 to 15 using a 4 bit byte in which each successive bit represents a doubling of the value of the previous bit, e.g., bit 0 has value 1, bit 1 has value 2, bit 3 has value 4 and bit 4 has value 8. One can then represent any value by turning on or off each successive bit. For example the value 3 is represented by bits 0 and 1 on, and bits 2 and 3 off (1+2+0+0=3). The value 11 is represented by bits 0, 1 and 3 on, and bit 2 off (1+2+0+8=11). In the alternative system known as Gray coding, one can uniquely define a sequence in which the transition from one integer value to the next higher or the next lower integer involves a change of only one bit.

By analogy, if the flow rates of a succession of paths are constructed to be in a binary sequence (e.g., 1, 2, 4, 8, 16 . . . ) one can "dial in" any flow rate represented by an integer amount of flow, where the integer is selected from the set of integers that the binary system covers (e.g., zero to $2^N-1$ for a system with N binary bits). In alternative embodiments, the values represented by the bits can be selected to be multiples of a fractional value (for example ⅔ rather than 1, so the maximum value become 10 rather than 15), or can be selected so that the progression is not by equal steps, but rather by steps having a predetermined relationship with each other. In the present system, the value represented by the digital system is a magnitude of a flow of a fluid, which is controlled by opening in succession a sequence of flow valvee paths in a predetermined order (or by closing the paths ion a predetermined order to shut off the flow). Using the flow control valves as described herein, one can control a flow rate of a fluid through the flow control valve such that the flow rate is determined according to a progression of open and closed states of valves in the plurality flow paths connected in parallel.

Each path is controlled by a poppet cap valve operated in on-off (e.g., fully open and fully closed) states. The poppet cap valves are not deliberately operated in states that represent being partially open (e.g., proportional operation of a valve) although it is recognized that such states can occur in cases of partial malfunction. To avoid erosion from sand in the oil and high speed flow, the seal area of the poppet cap valve is located at a distance from the flow inlet away from the high speed flow. The path is a multistage structure composed of jet orifice and settling chamber pairs. The pressure drop of each stage and, therefore, the flow speed at the orifice for a set flow rate is controlled by the number of stages. The paths have relatively small diameter or cross section (e.g., centimeters or fractions of centimeters) and are relatively long (e.g., meters) for large number of stages and still fit in the strict annular space limit between an inner pipe and a casing pipe in the typical downhole region of oil well.

FIG. 1 is a schematic diagram of a multi-path multi-stage flow control valve for an oil well downhole application. The multi-path flow control valve has M flow paths, where M is an integer greater than one. The inlet of the valve for the flow from the formation is located between an inner pipe and the casing pipe whereas the outlet is positioned towards the inner pipe. The available space for this downhole valve is an annular cylinder between the inner pipe and the casing pipe.

The valve comprises a parallel set of flow paths 105, 110, 115, 120 from inlet to outlet. Each path is controlled by a separate poppet cap valve that is operated in binary on-off states (i.e., digitally). The paths may have different flow resistances. The choke valve controls the total flow rate by opening a specific path or a combination of different paths. Of the M paths, M−1 paths have a structure that includes a plurality of stages, and one of the M paths has an orifice with no stages thereafter. The M−1 paths are each designed to provide when open a fractional part of the total flow that the valve can handle, while the path with no stages thereafter is designed to provide when open substantially the total flow that the valve can handle. In one embodiment the flow control valve has a path wherein the chamber of the last stage is the outlet.

The structure of a representative path 105 having multiple stages 130 is shown in FIG. 1. Each stage includes a relatively small cross-section and short tube as an orifice 132 and a relatively large cross-section pipe as a chamber (or settling chamber) 134. The flow exits from the orifice 132 as a turbulent jet, expanding its cross-section and losing speed as it flows downstream. This is a highly dissipative fluid flow and serves to efficiently drop the kinetic energy in a short distance. In some embodiments, an orifice is present at the outlet of a path. For a given path of the M paths, a number $N_I$ of stages is present, where $N_I$ is an integer that is greater than zero that describes the number of stages in a selected path I of the M paths.

As is shown in FIG. 1, the orifice sizes of different paths are different, larger orifices being provided for paths having higher flow rates. As shown in FIG. 1, the inlet poppet cap valve for each path is sized to conform to the intended relative flow rate of that path, larger poppet cap valves (e.g., having larger area) being provided for paths intended to have higher flow rates.

A simple poppet cap valve with no stages thereafter (e.g., the right-most poppet cap valve shown in FIG. 1, or path 120) can be provided to provide full flow (e.g., flow without any restrictor such a plurality of stages 130 beyond the poppet cap valve, corresponding to substantially the total flow that the multi-path valve can provide).

For a path having N identical stages of the same orifice and settling chamber structure, the total pressure difference ΔP between the valve inlet and outlet is equally distributed at each stage. When the cross-section of the chamber 134 is much greater than the diameter of the orifice 132, and the outlet of the chamber is far enough away, the flow velocity V through the orifices (which is the maximum flow velocity) in the path is given by $$V=(2\Delta P/N\rho)^{0.5}$$

where ρ is the density of the fluid of the flow. The flow rate q through the path is given by $$q=A_{orifice}V$$

where $A_{orifice}$ is the cross-section of the orifice.

The use of a large enough number of the stages can limit the maximum flow velocity to reduce the erosion rate for a long lifetime design.

Figure 2:
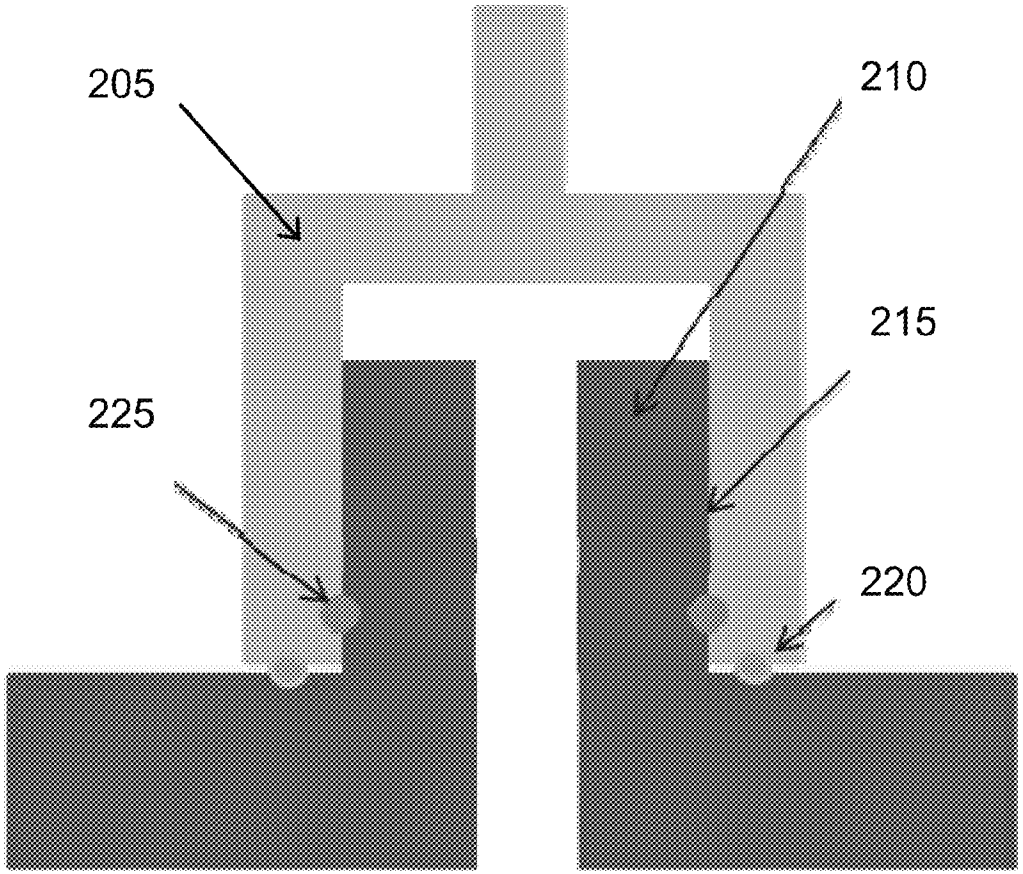
FIG. 2 is a cross sectional diagram of a poppet cap valve.

FIG. 2 is a cross sectional diagram of a poppet cap valve. A cap 205 on the inlet side is used to open or close the path. The orifice tube 210 is designed to be projected out from the seat base where the sealing surface (such as O ring 220) is located. A narrow spacing or gap 215 between the cap 205 and the orifice 210 is provided to limit the flow into the orifice upon initial opening of the path. Optionally additional seals such as O-ring 225 may be provided. This design makes possible the following improvements:

1. The sealing area is spaced away from the flow inlet to prevent erosion of the sealing area surfaces.
2. The orifice tube has a long length representing a sacrificial portion that can be eroded with no significant influence on the performance.
3. The pressure difference across the valve helps to secure the sealing when the valve is closed.

The maximum force F required to open the cap is the pressure difference times the cap sealed area, given by $F=\Delta P \times A_{cap}$. The total pressure difference ΔP has a maximum value when all paths are closed and decreases when some paths are opened. This multiple path configuration allows opening the paths in sequence (e.g., the smallest cap first) to reduce the required actuation force to operate the valve. The valve can be designed such that the smallest valve serves as a bleed valve to reduce the total pressure difference ΔP when the value of the total pressure difference ΔP exceeds some maximum value, thereby limiting the force needed to open the valve.

An example of design parameter selection and performance estimation is presented in Table 1. We assume the reservoir pressure is 7000 psi (48.3 Mpa) more than the pressure in the inner pipe P_inner, the maximum flow rate ($Q_{max}$) is 4000 barrels of fluid per day (BFPD) (or 636 $m^3$/day), the oil density is 900 kg/$m^3$, and the pressure drop in the formation is proportional to the flow rate.

In this embodiment, the valve is designed to be able to control the flow rate from 0% (closed valve) to 90% of the $Q_{max}$ in steps of 10% where 99% denotes a fully open valve. The valve comprises 10 paths corresponding to 10%-90% and 99% of $Q_{max}$ respectively when one of the paths is open. The paths have multiple stages of the orifice and chamber structure previously described and the chamber is a pipe having a 1" (25.4 mm) ID. In this embodiment, one opens paths beginning with the lowest flow path, and successively opens the next higher flow path while closing the path having the next lower flow until the intended flow rate is reached. This may take a number of steps of opening and closing paths, depending on how large a flow is desired.

The erosion rate at an orifice is generally proportional to $V^n$ where V is flow speed and the power n is greater than 2. See Haugen K., O. Kvemvold, A. Ronold, R. Sandberg (1995), "Sand erosion of wear-resistant materials: Erosion in choke valves", Wear 186-187, pp. 179-188. The reservoir pressure of 7000 psi (48.3 Mpa) is able to create an oil flow speed up to 350 m/s and results in serious erosion in flow control valve. In the present embodiment, we set the allowed maximum velocity as 50 m/s to reduce the possible erosion. The stages of each path are identical except the first orifice has a projected tube structure as shown in FIG. 2 and the chamber of the last stage is the inner pipe. The estimated number of stages for each path (stage number), flow velocity in the orifices (V) and diameter of the orifice (d_orifice) are listed in Table 1. When calculating the pressure across the poppet valve (ΔP) under flow we assume the pressure drop in the formation obeys Darcy's law, i.e., it is a linear relationship, and the pressure in the inner pipe is constant.

TABLE 1

The design parameters estimation of the multi-path multi-stage valve for one embodiment

| Q/Qmax | 0.1 | 0.2 | 0.3 | 0.4 | 0.5 | 0.6 | 0.7 | 0.8 | 0.9 | 0.99 |
|---|---|---|---|---|---|---|---|---|---|---|
| ΔP (psi) | 6300 | 5600 | 4900 | 4200 | 3500 | 2800 | 2100 | 1400 | 700 | 70 |
| Stage number | 39 | 35 | 31 | 26 | 22 | 18 | 13 | 9 | 5 | 1 |
| $\Delta p_{Stage}$ (psi) | 161.54 | 160.00 | 158.06 | 161.54 | 159.09 | 155.56 | 161.54 | 155.56 | 140.00 | 70.00 |
| V (m/s) | 49.75 | 49.51 | 49.21 | 49.75 | 49.37 | 48.82 | 49.75 | 48.82 | 46.32 | 32.75 |
| d_orifice (mm) | 4.340 | 6.153 | 7.559 | 8.681 | 9.742 | 10.732 | 11.484 | 12.393 | 13.495 | 16.832 |
| L_cham (mm) | 100 | 110 | 125 | 150 | 175 | 175 | 200 | 225 | 225 | |

where Q/Qmax is the ratio of the flow rate when a corresponding path opened to the maximum flow rate, ΔP is the pressure difference across the valve, $\Delta p_{Stage}$ is the pressure drop created by each stage, V is the velocity in an orifice in the respective path, d_orifice is the diameter of orifice opening, and L_cham is the length of a chamber.

According to the turbulence jet theory (as presented in Cushman-Roisin B., Environmental Fluid Mechanics, Chapter 9, Turbulent Jets, John Wiley & Sons, Inc., New York, 2012), a circular cross section jet from an orifice into an open space will entrain surrounding fluid and expand its cross section along the downstream distance. The maximum speed is at its central axis and decays with the distance. The maximum speed (U_max) is calculated at the distance of the chamber length (L_cham). In the pipe having a limited diameter the flow will converge to a turbulent flow with a uniform velocity profile at long enough distance. That velocity is calculated as Uaver. The maximum of U_max and Uaver is considered the maximum velocity of the flow into the end of the chamber. The possible maximum velocities are controlled to be ~13 m/s or less by choosing the appropriate length of the chamber. Taking into account this non-zero velocity from the previous stage the flow velocity in the orifice is updated as V_updated. The velocities have very small increase in this embodiment.

The force needed to pull the poppet cap against the pressure is calculated as F_pull. The sealed area is assumed to have a diameter of d_orifice+6 mm. In addition, it is assumed that when opening the path for a set flow (say 0.6 Qmax) the path for previous set flow (0.5 Qmax) is opened and all other paths were closed. L_total is the total length of the multi stage path. The length of each stage is the chamber length plus the orifice length, L_cham+(Orifice L). The orifice length is set to 15 mm to provide an inlet orifice that will tolerate long-term erosion.

The actuators in the preferred embodiment are rotary motors that rotate a cam which linearly move the poppet arm however each poppet could be controlled by a single actuator configured to open and close the poppet. In addition the actuator may be a tool that is sent downhole which can be designed to drive a mechanism which can open or close each individual poppet valve.

Figure 5:
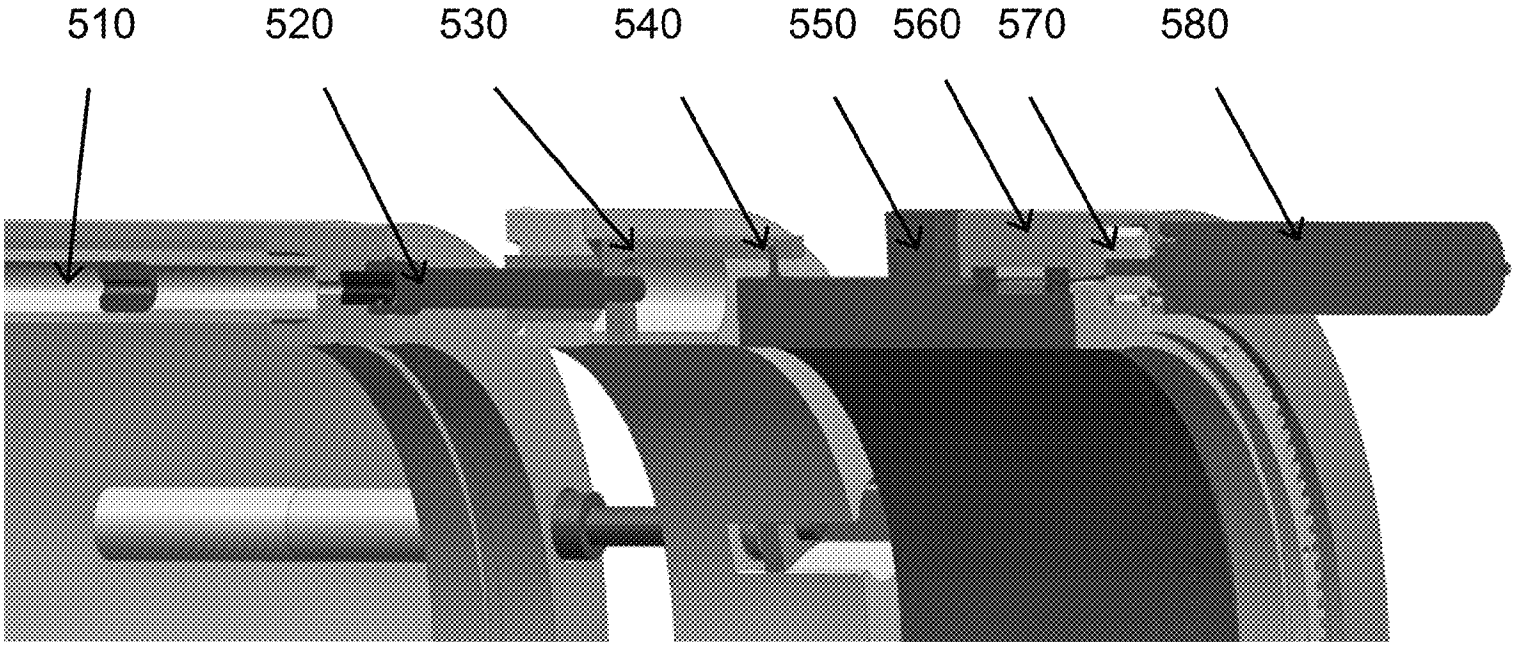
FIG. 5 is a diagram illustrating the details of one embodiment of a valve embodiment according to principles of the invention.

The analytical results show that the maximum velocity can be limited at the orifices to approximately 50 m/s, and approximately 13 m/s inside the chambers. These speeds are manageable. The maximum number of stages is 39, where the chamber's inner diameter is 1" (25.4 mm) and maximum path length is less than 4.5 meters. These dimensions can fit in typical oil well downhole annular spaces even the paths are arranged as straight lines. The paths may be folded by using U shape chambers. The maximum required force to open the path poppet cap valves is less than 6000 N and this could be operated by linear actuators comprising reasonably small motors with gearing mechanisms, as shown in FIG. 3B and FIG. 5.

Figure 3A:
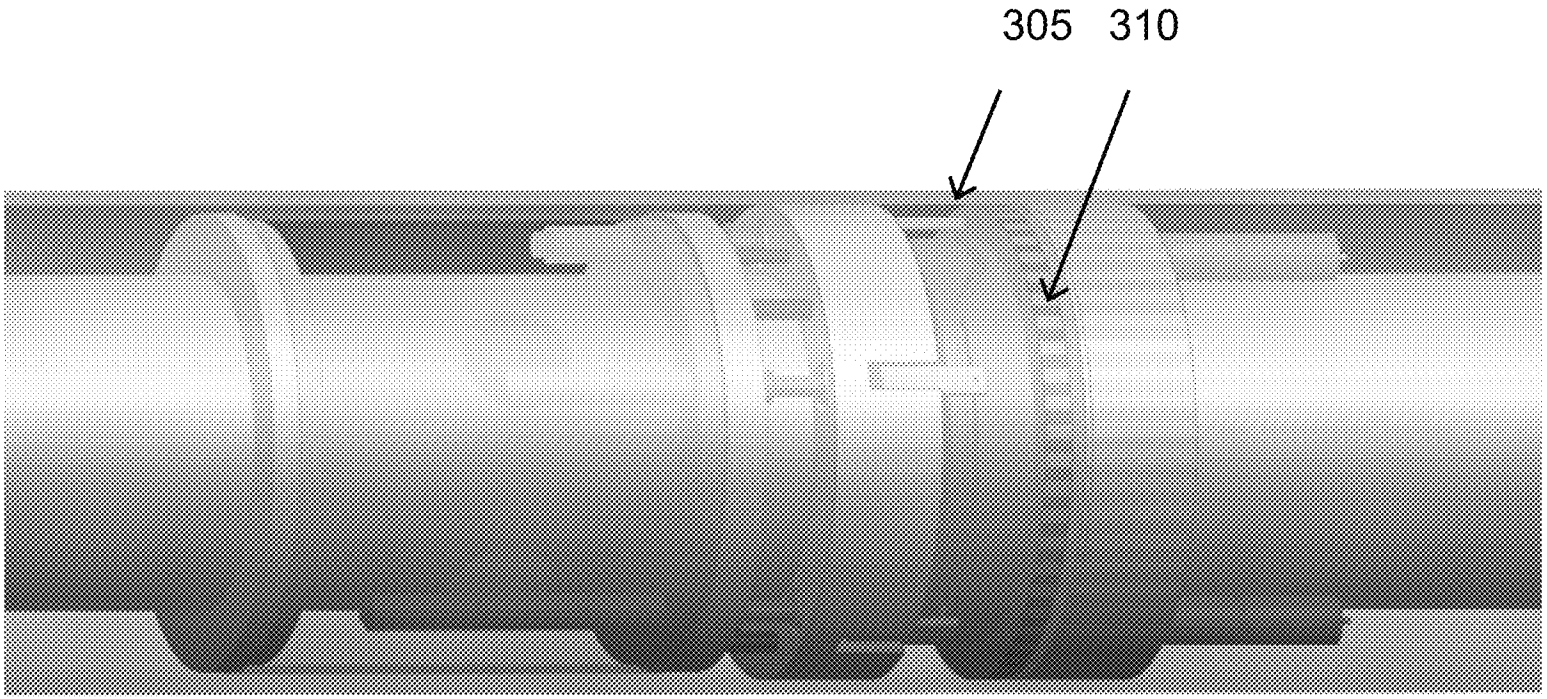
FIG. 3A is a diagram illustrating a pipe in which a system in which multiple paths can be controlled by a single actuator is situated.
Figure 3B:
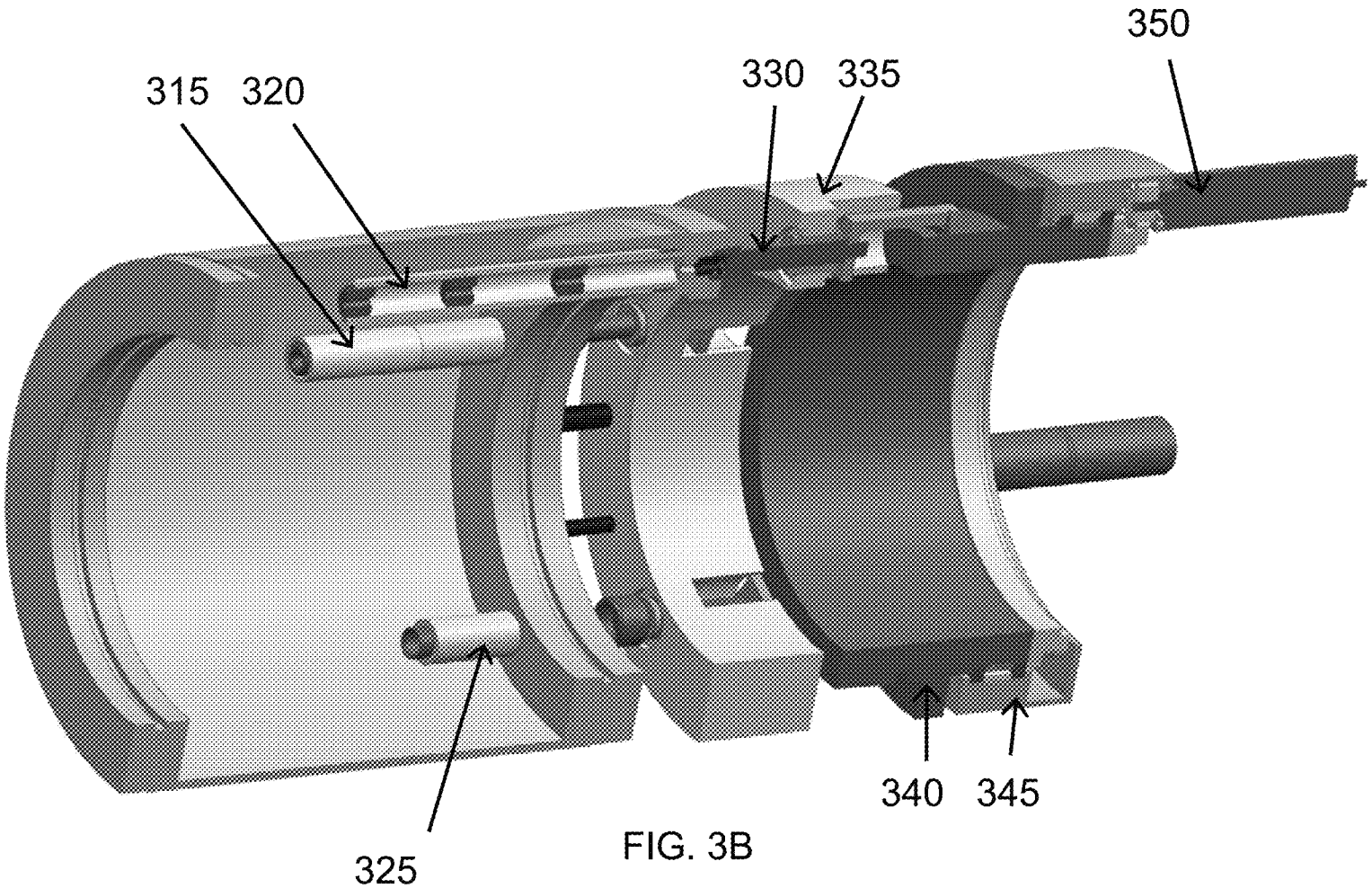
FIG. 3B is a cutaway diagram illustrating the components of a system in which multiple paths can be controlled by a single actuator.

FIG. 3A is a diagram illustrating a pipe 305 in which a system 310 in which multiple paths can be controlled by a single actuator is situated. FIG. 3B is a cutaway diagram illustrating the components of a system in which multiple paths can be controlled by a single actuator. In FIG. 3B there are shown multiple paths 315, 320, 325. Poppet cap valve 330 is provided in path 320, which path is shown in cutaway.

Support ring 335 controls the linear direction of motion of poppet cap valve 330. An actuator, in this embodiment annular cam 340, is used to control the motion of poppet cap valve 330. Annular cam 340 cooperates with support ring 345, and is rotated by a motor and shaft 350 having a gear the turns annular cam 340 by meshing with a circumferential gear present on the outside of the cam 340. The design allows the use of a single actuator or a plurality of actuators for redundancy.

Figure 4:
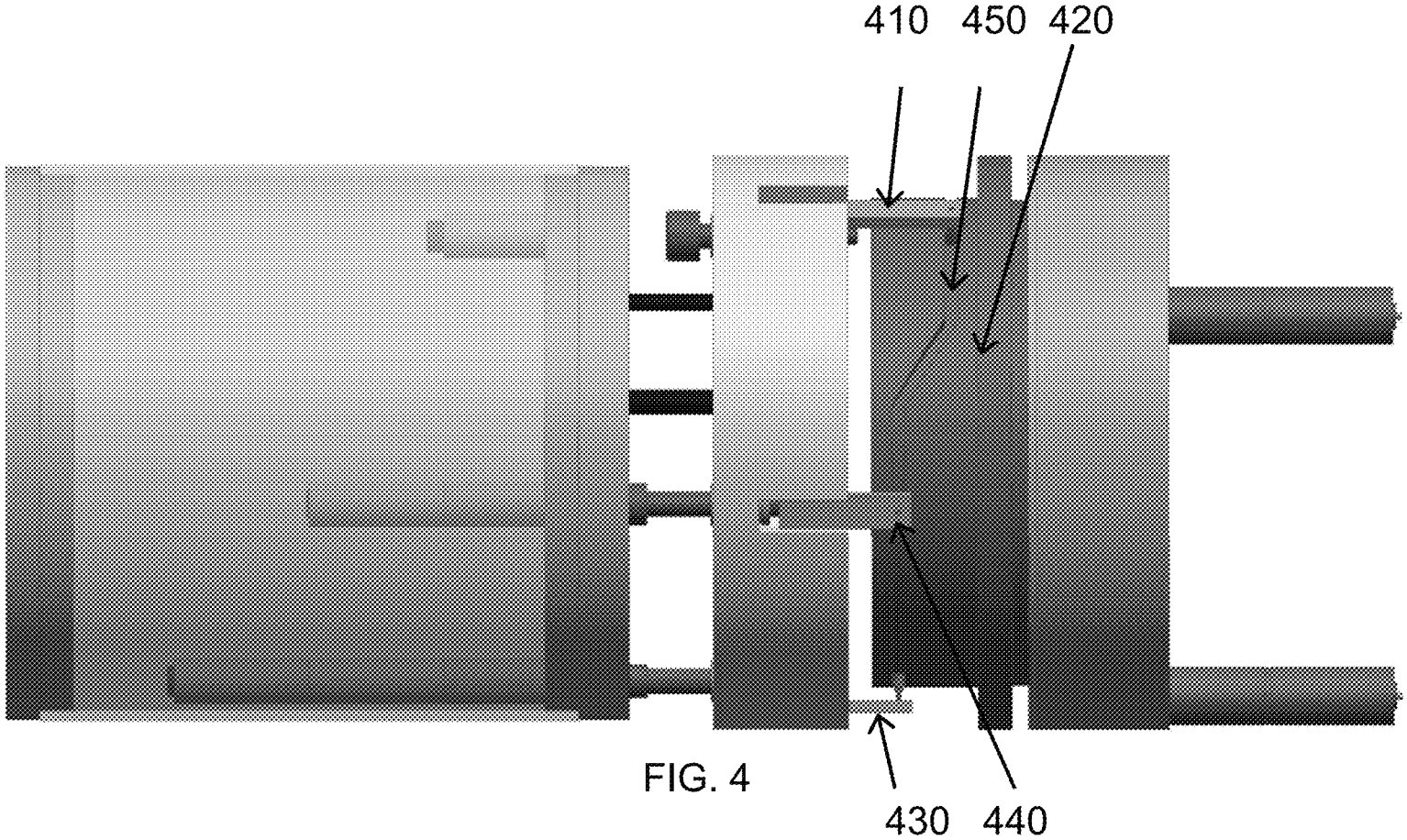
FIG. 4 is a diagram illustrating an embodiment in which an annular cam converts rotary motion into linear motion and can control multiple poppets that open and close respective flow paths connected in parallel.

FIG. 4 is a diagram illustrating an embodiment in which an annular cam 420 converts rotary motion into linear motion. Cam 420 has a circumferential groove 450 that defines the state (open or closed) of multiple poppets 410, 430, 440 that open and close respective flow paths connected in parallel.

FIG. 4 shows a design implementation in which three flow paths connected in parallel are provided. In one embodiment, a plurality of actuators drives the annular CAM. The actuators are working in parallel so if any one of them is malfunctioning the other actuators can back-drive it. The three flow paths connected in parallel were configured such that each one of them can be open independently and any adjacent two can work at the same time. The valve has six states of flow rate control corresponding to all paths closed; path 1 open and the others closed; path 2 open and the others closed; path 3 open and the others closed; path 1 and path 2 open and path 3 closed; and path 2 and path 3 open and path 1 closed.

The actuators compartment can be separated from the cam and poppets compartment to prevent the harmful fluids to reach the actuators and the control electronics. This compartment can be fully flooded with a dielectric fluid and a membrane in the housing can be provided to allow pressure transfer between the actuators compartment and the surrounding environment to reduce the requirements of the actuators housing.

FIG. 5 is a diagram illustrating the details of one embodiment of a valve embodiment according to principles of the invention. A path 510 is shown in cross section. Poppet valve 520 is displaced by arm 530 to open and close path 510. Arm 530 cooperates with cam 550 by way of structure 540 that follows a circumferential groove as illustrated in FIG. 4. Cam 550 is driven by gear 570 which in turn is driven by motor 580. Cam 550 is held in rotary alignment by bearing 560.

The arm connecting the poppet and the roller shown in FIG. 5 is preferably used to provide a low force on the poppet situation as is the case for low pressure differential between the two faces of the poppet. If higher force is required to move the poppet, as in the case of high pressure differential, two possible solutions can be implemented.

Figure 6A:
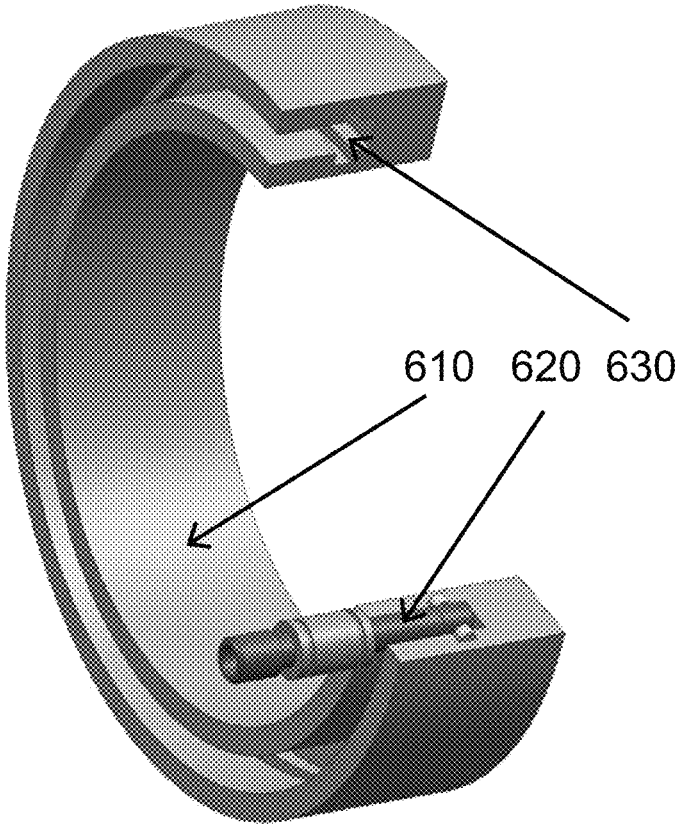
FIG. 6A is a diagram of a cam that controls a poppet cap valve with axial rollers.

FIG. 6A is a diagram of a cam that controls a poppet cap valve with axial rollers.

A first embodiment is shown in FIG. 6A in which two rollers are present inside a cavity 630 in the cam 610. The cavity 630 provides a mechanical control signal in a manner analogous to the groove 450 in the cam 420 of FIG. 4, but in an axial orientation relative to the controlled poppet valve. This design can be used to apply appreciable more force than the embodiment illustrated in FIG. 5.

Figure 6B:
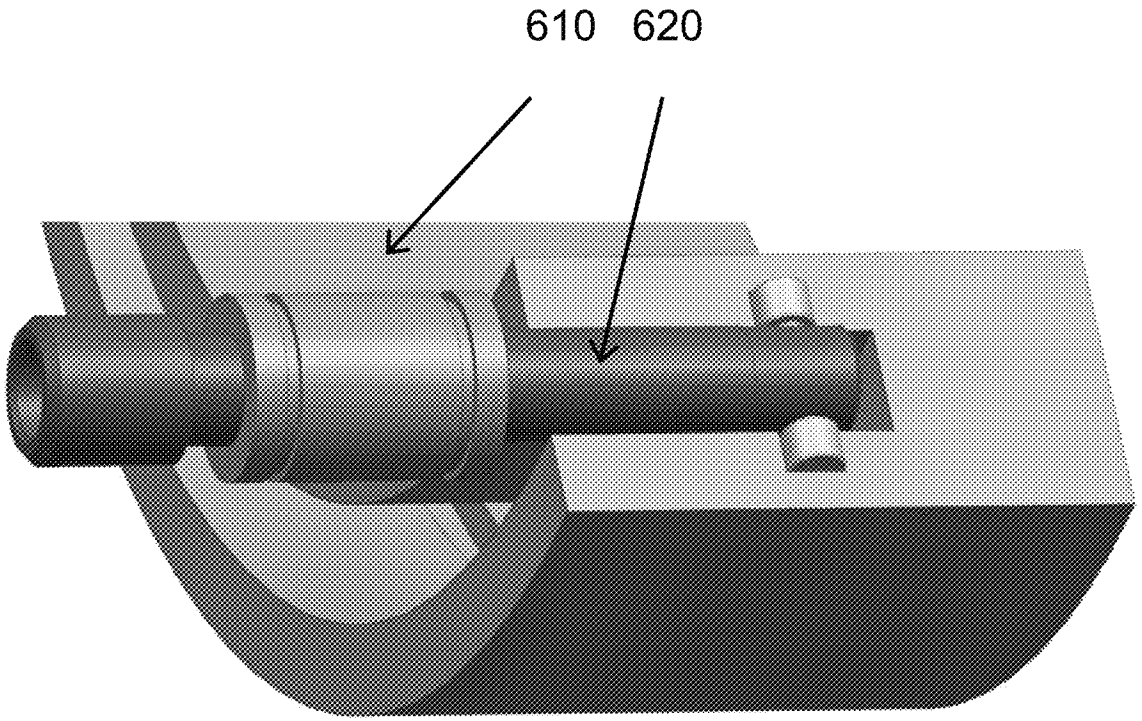
FIG. 6B is a second embodiment of a cam that controls a poppet cap valve with axial rollers.

FIG. 6B is a second embodiment of a cam 610 that controls a poppet cap valve 620 with axial rollers. The embodiment illustrated in FIG. 6B uses one linear actuator for each poppet. The actuator does not require an arm that has to support lateral forces as are present in the embodiment of FIG. 3B, FIG. 4 or FIG. 5. In addition to handling large forces, this embodiment allows for a reduced number of parallel paths but a larger number of combinations of open parallel paths and so a better flow control through the valve.

Figure 7:
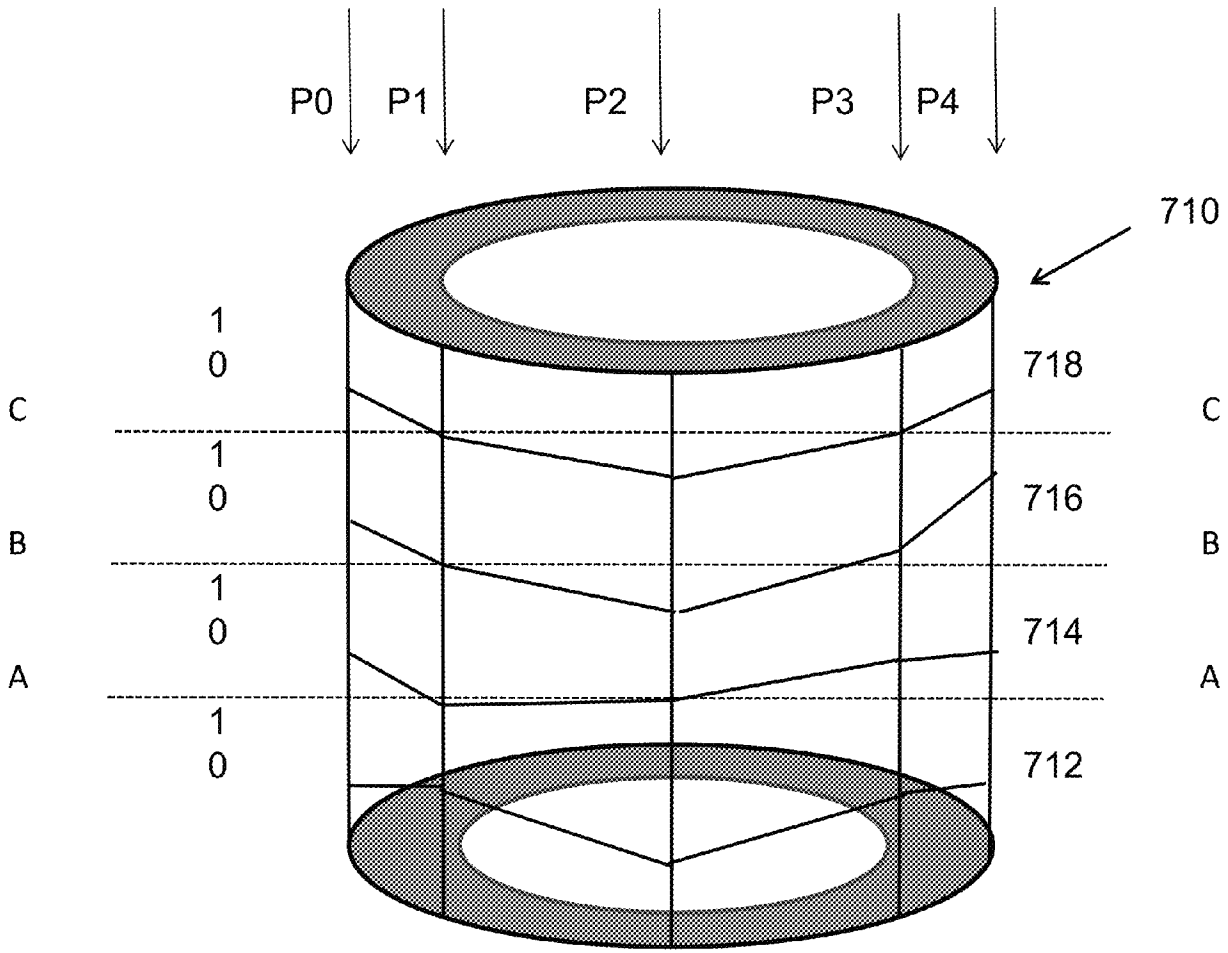
FIG. 7 is a diagram that illustrates another embodiment of a cam that has a plurality of grooves, each used to control one of a plurality of poppet cap valves.

FIG. 7 is a diagram that illustrates another embodiment of a cam 710 that has a plurality of grooves 712, 714, 716, 718, each used to control one of a plurality of poppet cap valves, which in turn control the state of a respective path. The embodiment of FIG. 7 contemplates four poppet valves, situated at defined angular spacing (such as 90 degree spacing) about the annular region between the outer pipe and the inner pipe. The defined spacing allows the cam to be rotated by the correct angle to actuate one or more poppet valves. In the embodiment shown, the cam 710 is designed to operate with 16 rotational positions (corresponding to $4^2=16$ configurations that the four poppet valves and four paths can attain with two states per path), which in one embodiment are set at respective rotations of no more than 360/16 degrees (or 22.5 degrees) angular spacing. The four grooves 712, 714, 716 and 718 are designed to represent a code (such as a standard binary code, or a Gray code). The lengths of the arms (corresponding to element 530 in FIG. 5) are each different, so that each poppet valve cap can be seated when the four grooves 712, 714, 716 and 718 are set to the zero position (e.g., the groove that controls each poppet valve is set nearest the respective valve). Each groove can have only one of two values at each of the 16 rotational positions. The grooves are smooth and continuous so that a poppet valve will move smoothly from open to closed (or the reverse) as the cam is driven. In some embodiments, the angular spacing of the poppet valves, and the paths they control, can be any convenient angular spacing, and can differ between different paths.

As may be seen from consideration of Table 2, Gray code is simply a reordering of (or reassignment of values to) the same 8 different patterns (e.g., all of the possible patterns that one can generate with 3 bits). Gray code has the property that only one bit of a representation changes at each step of advancing through the code.

TABLE 2

| Decimal value | Gray code representation | Binary representation |
|---|---|---|
| 0 | 000 | 000 |
| 1 | 001 | 001 |
| 2 | 011 | 010 |
| 3 | 010 | 011 |
| 4 | 110 | 100 |
| 5 | 111 | 101 |
| 6 | 101 | 110 |
| 7 | 100 | 111 |

The cam 710 of FIG. 7 can be constructed so that a single motor drives the entire cam. In FIG. 7, the angular positions P0, P1, P2 P3 and P4 correspond to the numerical binary representations 0000 (decimal 0), 0001 (decimal 1), 0010 (decimal 2), 0011 (decimal 3), and 0100 (decimal 4). The numeral pairs (0,1) along the left side are intended to indicate a state of a groove.

The groove 712 correspond to the ones bit of a four bit sequence. It takes on the value 0 at position 0 (P0), the value 1 at P1, the value 0 at P2, the value 1 at P3 and the value 0 at P4. The groove 714 corresponds to the twos bit of the four bit sequence. It takes on the value 0 at position 0 (P0), the value 0 at P1, the value 1 at P2, the value 1 at P3 and the value 0 at P4. The groove 716 corresponds to the fours bit of the four bit sequence. It takes on the value 0 at position 0 (P0), the value 0 at P1, the value 0 at P2, the value 0 at P3 and the value 1 at P4. The groove 718 corresponds to the eights bit of the four bit sequence. It takes on the value 0 at position 0 (P0), the value 0 at P1, the value 0 at P2, the value 0 at P3 and the value 0 at P4. The corresponding poppet valves are closed when the groove their control arm follows has the value 0, and are opened when the groove has the value 1.

In an alternative embodiment, the cam 710 can be divided into individual cam annuli (for example by cutting the cam 710 normal to its rotation axis at the dotted lines A-A, B-B and C-C), one for each poppet valve, and each annulus having a groove with only two states (corresponding to pen and closed poppet valve states), but requiring a drive motor for each annulus so that each annulus (and each poppet valve) can be operated independently of any other annular and its associated poppet valve. In such an embodiment, the timing and the sequence of motions applied to the individual cam annuli define the binary states of the poppet valves.

Figure 8:
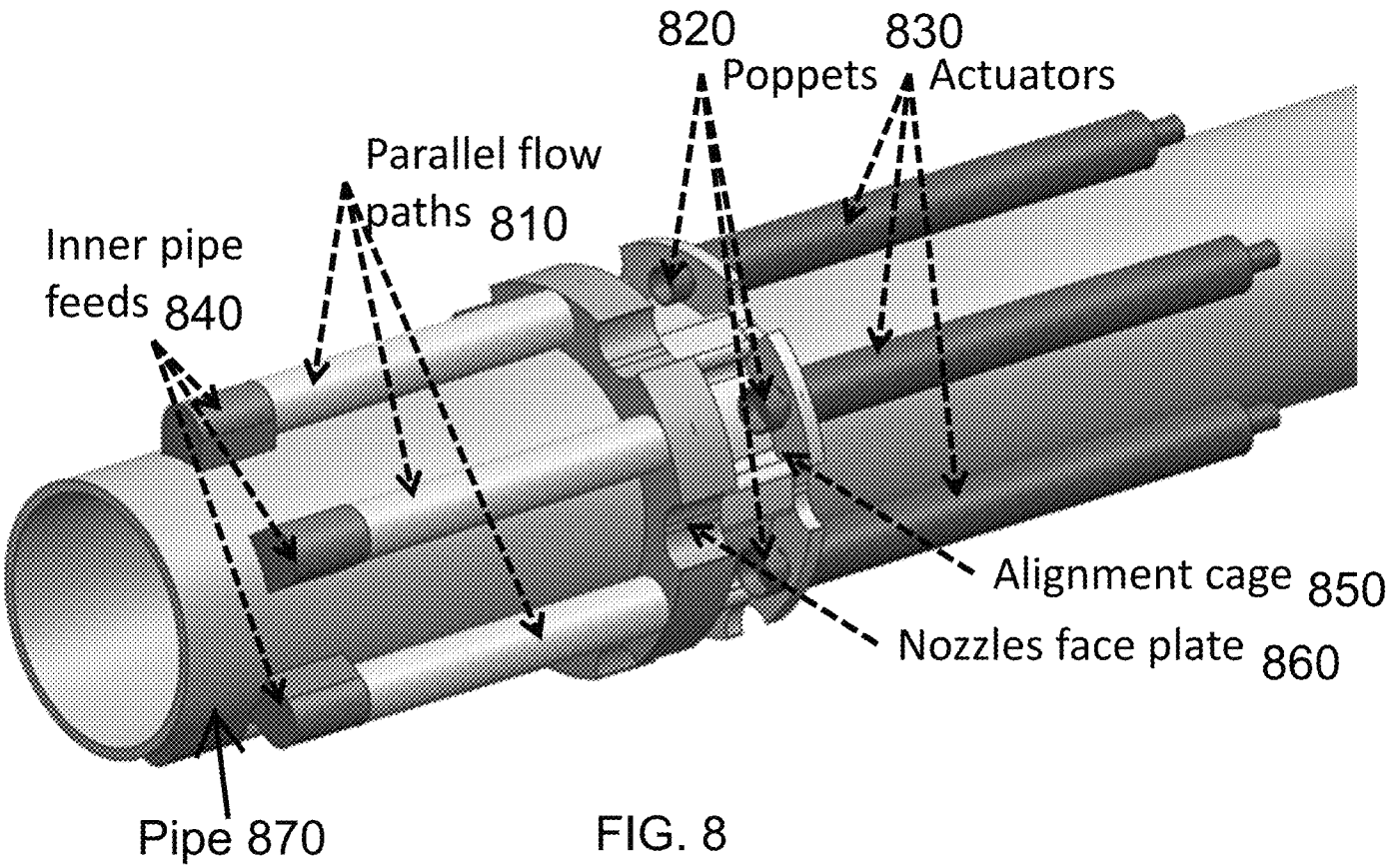
FIG. 8 is a diagram in perspective view that illustrates an embodiment having a plurality of paths each operated by a motor.

FIG. 8 is a diagram in perspective view that illustrates an embodiment having a plurality of flow paths 810 each operated by a motor. In the embodiment illustrated in FIG. 8 poppets 820 are controlled by respective actuators 830. An alignment cage 850 and a nozzle face plate 860 are mated to each other are provided to align the actuators 850 with the respective poppet valves 820. Inner pipe feed 840 are provided to connect the outlet end of each respective flow path 810 with the inner pipe 870.

Figure 9:
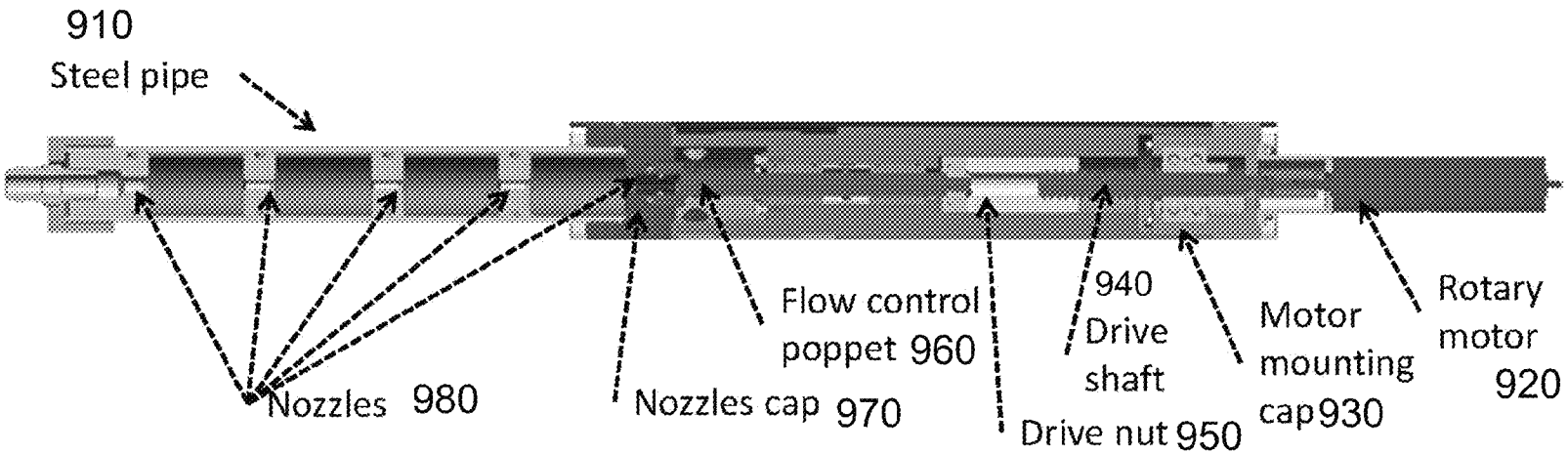
FIG. 9 is a diagram in cross section showing an embodiment of one path and its actuation mechanism.

FIG. 9 is a diagram in cross section showing an embodiment of one path and its actuation mechanism. In the embodiment shown in FIG. 9, a steel pipe 910 is provided to contain the components that make up the flow path, such as nozzles 980 and the open spaces between the nozzles that are referred to herein as stages. A nozzle cap 970 and a flow control poppet 960 are provided so that the path can be held in an open (flow passes) state or in a closed (flow is cut off) state. The poppet 960 is actuated by way of a drive nut 950 and a drive shaft 940 which are driven by a motor 920, which can be a rotary motor. The motor 920 is mounted to the apparatus with a motor mounting cap 930.

Figure 10:
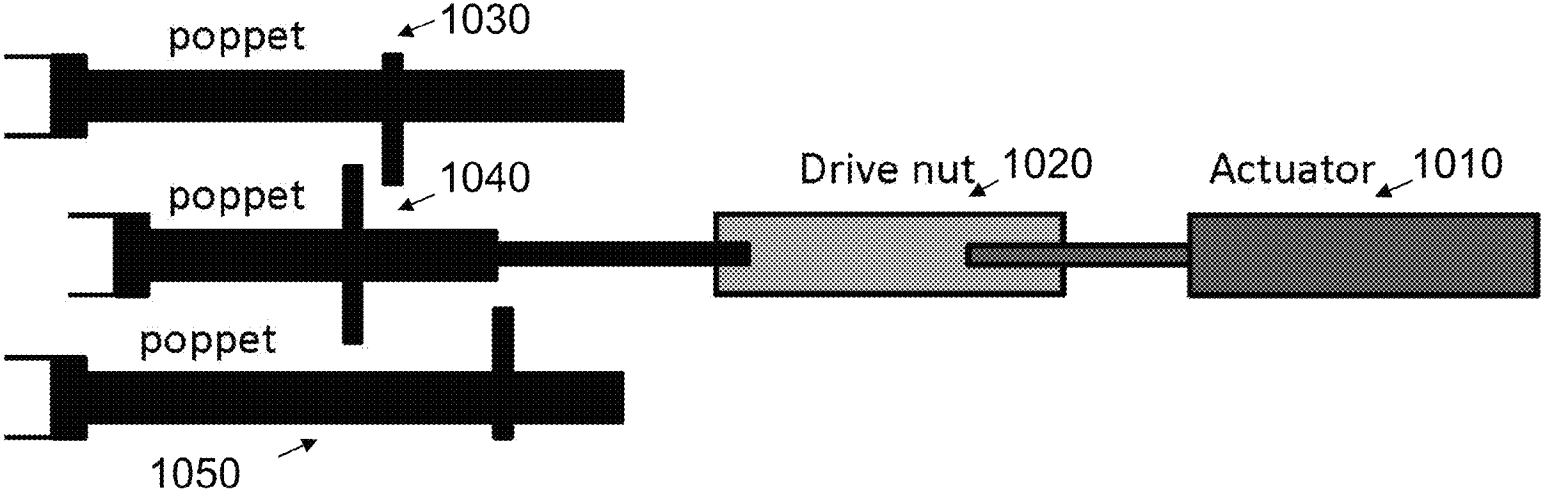
FIG. 10 is a schematic diagram showing an embodiment in which one actuator operates a plurality of poppet cap valves in a predetermined sequence.

FIG. 10 is a schematic diagram showing an embodiment in which one actuator operates a plurality of poppet cap valves in a predetermined sequence. In the embodiment of FIG. 10, an actuator 1010 act by way of a drive nut 1020 to directly operate a poppet 1040. Poppet 1040 is so arranged that it has a mechanical interference with each of poppets 1050 and 1030 which causes the one poppet to contact the other poppet when they are in certain predetermined relationships. As poppet 1040 is moved (as illustrated in FIG. 10, to the right), it first contacts poppet 1050, and if it continues to move rightward, actuates poppet 1050. If poppet 1040 moves still further to the right, it comes into contact with poppet 1030 and actuates that poppet as well. Since the pressure from a reservoir such as an oil formation is applied on the right side of the schematic diagram, if poppet 1040 moves leftward the other poppets will move with it because the applied pressure causes them to move. As illustrated, when poppet 1040 is moved leftward by the actuator, poppets 1030 and 1050 will follow and will close their respective paths in the order opposite to that in which the paths were opened if poppet 1040 moves far enough leftward.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, patent application publication, journal article, book, published paper, or other publicly available material identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A flow control valve, comprising:

a plurality M of flow paths connected in parallel, where M is an integer greater than one, each of said plurality M of flow paths connected in parallel having a fluid connection at one end to an inlet and having a fluid connection at a second end to an outlet;

each of said plurality M of flow paths connected in parallel having at least one poppet valve that is sized in proportion to a flow capacity of the flow path;

M−1 of said plurality M of flow paths connected in parallel each having a respective plurality $N_I$ of stages arranged in series, each stage comprising an orifice and a chamber, where $N_I$ is an integer that is greater than one that describes the number of stages arranged in series;

a remaining flow path of said plurality M of flow paths comprising an orifice between the inlet and the outlet; and at least one actuator operatively connected to at least one of said poppet valves, said at least one actuator operable to place said at least one of said poppet valves in one of a fully open state and a fully closed state;

wherein:

a cross section of the orifice of said each stage and a cross section of the chamber of said each stage are configured to create a flow exiting the orifice into the chamber as a turbulent jet, the chamber serving as a settling chamber, flow rates of the M−1 flow paths are configured according to a progression, from a low flow rate of a first flow path of the M−1 flow paths to a flow rate of a last flow path of the M−1 flow paths that is lower than a high flow rate, the progression of flow rates being based on increasing a diameter of the orifice, increasing a length of the chamber, and decreasing a number of stages $N_I$, a diameter of the orifice of the remaining flow path defines the high flow rate through the flow control valve, said flow control valve is operable to permit a controlled flow of a fluid therethrough based on opening in succession a sequence of flow paths according to an increasing flow rate of the flow paths, starting from the first flow path having the low flow rate, the opening in succession causing a decreasing in succession of a pressure difference between the inlet and the outlet for a reduced activation force of the at least one actuator, and selection of a flow rate of the flow control valve is based on the fully open and the fully closed states of the at least one poppet valve of the each of said plurality M of flow paths.

2. The flow control valve of claim 1, wherein said plurality M of flow paths connected in parallel fit within an annular cylinder between an inner pipe and a casing pipe of an oil well.

3. The flow control valve of claim 1, wherein said flow control valve is operable to provide a flow having a flow rate determined according to a progression of said fully open and said fully closed states of said poppet valves of said plurality M of flow paths connected in parallel.

4. The flow control valve of claim 1, wherein said at least one actuator is an annular cam.

5. The flow control valve of claim 1, wherein said at least one actuator comprises a plurality of annular cams.

6. The flow control valve of claim 1, wherein said at least one actuator is a motor.

7. The flow control valve of claim 1, wherein a first poppet of a first flow path of the plurality M of flow paths has a mechanical interference with a second poppet of a second flow path of the plurality M of flow paths, the mechanical interference when engaged communicating a drive force from said at least one actuator to the second poppet by way of direct contact between the first poppet and the second poppet.

8. The flow control valve of claim 1, wherein a sealing area between the at least one poppet valve of the each of said plurality M of flow paths and an orifice of the each of said plurality M of flow paths to the inlet is located on the outside surface of the orifice or on the base of the orifice.

9. The flow control valve of claim 1, wherein said controlled flow is determined by a state in which only one of said plurality M of flow paths connected in parallel is open.

10. The flow control valve of claim 1, wherein said controlled flow is determined by a state in which at least two of said plurality M of flow paths connected in parallel are open.

11. The flow control valve of claim 1, wherein each of said plurality M of flow paths is a tubular pipe, the inlet being an inlet to the tubular pipe to allow entering of the fluid into the tubular pipe, and the outlet being an outlet of the tubular pipe to allow exiting of the fluid from the tubular pipe.

12. The flow control valve of claim 11, wherein the chamber of the each stage is formed by the tubular pipe.

13. The flow control valve of claim 1, wherein for each flow path of the M−1 flow paths, the diameter of the orifice, structure of the chamber, and the number of stages $N_I$ are configured to limit the flow rate of the each flow path to a maximum flow rate to reduce erosion.

14. The flow control valve of claim 13, wherein the maximum flow rate is in correspondence of a maximum flow velocity of 50 m/s.

15. The flow control valve of claim 1, wherein for each flow path of the M−1 flow paths, a total pressure between the inlet and the outlet is equally distributed at each stage of the respective plurality $N_I$ stages.

16. A method of controlling a flow rate of a fluid, comprising the steps of:

a) providing a flow control valve, comprising:

an inlet for receiving a fluid and an outlet for delivering said fluid; and a plurality M of flow paths connected in parallel, where M is an integer greater than one, each of said plurality M of flow paths connected in parallel having a fluid connection at one end to said inlet and having a fluid connection at a second end to said outlet, flow rates of the plurality M of flow paths configured according to a progression, from a low flow rate of a first flow path of the M flow paths to a high flow rate of a last flow path of the plurality of M flow paths;

the last flow path having a flow capacity when open of substantially the total flow that the valve can provide, and each of the remaining M−1 flow paths connected in parallel having a respective flow capacity when open of a fractional part of the total flow that the valve can provide;

each of said plurality M of flow paths connected in parallel each having a poppet valve of a plurality of poppet valves that is sized in proportion to said respective flow capacity of said flow path, the plurality of poppet valves comprising poppet valves of progressive sizes, from a smaller size poppet valve associated to the first flow path to a larger size poppet valve associated to the last flow path;

the remaining M−1 of said plurality M of flow paths connected in parallel each having a respective plurality of stages, each stage comprising an orifice and a chamber, the stages constructed to reduce a pressure of a fluid flowing through said respective one of said plurality M of flow paths connected in parallel, the progression of the flow rates being based on an increased diameter of the orifice, increased length of the chamber, and decreased number of stages $N_I$; and at least one actuator operatively connected to at least one of said poppet valves, said at least one actuator operable to place said at least one of said poppet valves in one of a fully open state and a fully closed state;

b) connecting said inlet of said flow control valve to a reservoir of fluid at a pressure difference P+ΔP with respect to said outlet;

c) connecting said outlet of said flow control valve to a reservoir to receive fluid passing through said flow control valve; and d) operating said at least one actuator to open one or more of said poppet valves of said plurality M of flow paths connected in parallel so as to cause a flow of said fluid at a predetermined flow rate, wherein the step of operating comprises opening in succession a sequence of flow paths of the plurality of M flow paths according to an increasing flow rate of the flow paths, starting from the first flow path having the low flow rate, the opening in succession causing a decreasing in succession of the pressure difference for a reduced activation force of the at least one actuator, wherein:

the operating of said at least one actuator first opens the smaller size poppet valve with a reduced actuation force.

17. The method of controlling a flow rate of a fluid of claim 16, wherein said reservoir of fluid at said pressure difference P+ΔP is a production zone of an oil well.

18. The method of controlling a flow rate of a fluid of claim 16, wherein said flow of said fluid at said predetermined flow rate results in a pressure difference P between said outlet and inlet.

19. The method of controlling a flow rate of a fluid of claim 16, wherein said flow of said fluid in one path of said plurality M of flow paths connected in parallel has a maximum flow velocity V given by $$V=(2\Delta P/N_I\rho)^{0.5}$$

where ΔP is the pressure drop between the inlet and the outlet, $N_I$ is an integer that is greater than one that describes the number of stages in a selected open path I of the M paths, and ρ is the density of the fluid.

20. The method of controlling a flow rate of a fluid of claim 16, further comprising:

i) based on the opening of the smaller size poppet valve, reducing the pressure difference between the inlet and the outlet;

ii) based on the reducing, operating an actuator of said at least one actuator with a reduced force to open a smaller size poppet valve of remaining closed poppet valves.

21. The method of controlling a flow rate of a fluid of claim 20, further comprising:

repeating steps i) and ii) for all closed poppet valves;

based on the repeating, providing a high flow rate of said fluid through the flow control valve while limiting a flow rate of said fluid through each of the M−1 flow paths to a maximum flow rate to reduce erosion.

22. The method of controlling a flow rate of fluid of claim 21, wherein for each flow path of the M−1 flow paths, the diameter of the orifice, structure of the chamber, and the number of stages $N_I$ are configured to provide the maximum flow rate.

23. The method of controlling a flow rate of fluid of claim 22, wherein the maximum flow rate is in correspondence of a maximum flow velocity of 50 m/s.

24. A flow control valve, comprising:

a plurality M of flow paths connected in parallel, where M is an integer greater than one, each of said plurality M of flow paths connected in parallel having a fluid connection at one end to an inlet and having a fluid connection at a second end to an outlet;

each of said plurality M of flow paths connected in parallel having at least one poppet valve that is sized in proportion to a flow capacity of the flow path;

M−1 of said plurality M of flow paths connected in parallel each having a respective plurality $N_I$ of stages arranged in series, each stage comprising an orifice and a chamber, where $N_I$ is an integer that is greater than one that describes the number of stages arranged in series;

a remaining flow path of said plurality M of flow paths comprising an orifice between the inlet and the outlet; and at least one actuator operatively connected to at least one of said poppet valves, said at least one actuator operable to place said at least one of said poppet valves in one of a fully open state and a fully closed state;

wherein:

flow rates of the M−1 flow paths are configured according to a progression, from a low flow rate of a first flow path of the M−1 flow paths to a flow rate of a last flow path of the M−1 flow paths that is lower than a high flow rate, the progression of flow rates being based on increasing a diameter of the orifice, increasing a length of the chamber, and decreasing a number of stages $N_I$, a diameter of the orifice of the remaining flow path defines the high flow rate through the flow control valve, said flow control valve is operable to permit a controlled flow of a fluid therethrough based on opening in succession a sequence of flow paths according to an increasing flow rate of the flow paths, starting from the first flow path having the low flow rate, the opening in succession causing a decreasing in succession of a pressure difference between the inlet and the outlet for a reduced activation force of the at least one actuator, selection of a flow rate of the flow control valve is based on the fully open and the fully closed states of the at least one poppet valve of the each of said plurality M of flow paths, and a first poppet of a first flow path of the plurality M of flow paths has a mechanical interference with a second poppet of a second flow path of the plurality M of flow paths, the mechanical interference when engaged communicating a drive force from said at least one actuator to the second poppet by way of direct contact between the first poppet and the second poppet.

25. A flow control valve, comprising:

a plurality M of flow paths connected in parallel, where M is an integer greater than one, each of said plurality M of flow paths connected in parallel having a fluid connection at one end to an inlet and having a fluid connection at a second end to an outlet;

each of said plurality M of flow paths connected in parallel having at least one poppet valve that is sized in proportion to a flow capacity of the flow path;

M−1 of said plurality M of flow paths connected in parallel each having a respective plurality $N_I$ of stages arranged in series, each stage comprising an orifice and a chamber, where $N_I$ is an integer that is greater than one that describes the number of stages arranged in series;

a remaining flow path of said plurality M of flow paths comprising an orifice between the inlet and the outlet; and at least one actuator operatively connected to at least one of said poppet valves, said at least one actuator operable to place said at least one of said poppet valves in one of a fully open state and a fully closed state;

wherein:

flow rates of the M−1 flow paths are configured according to a progression, from a low flow rate of a first flow path of the M−1 flow paths to a flow rate of a last flow path of the M−1 flow paths that is lower than a high flow rate, the progression of flow rates being based on increasing a diameter of the orifice, increasing a length of the chamber, and decreasing a number of stages $N_I$, a diameter of the orifice of the remaining flow path defines the high flow rate through the flow control valve, said flow control valve is operable to permit a controlled flow of a fluid therethrough based on opening in succession a sequence of flow paths according to an increasing flow rate of the flow paths, starting from the first flow path having the low flow rate, the opening in succession causing a decreasing in succession of a pressure difference between the inlet and the outlet for a reduced activation force of the at least one actuator, selection of a flow rate of the flow control valve is based on the fully open and the fully closed states of the at least one poppet valve of the each of said plurality M of flow paths, and for each flow path of the M−1 flow paths, a total pressure between the inlet and the outlet is equally distributed at each stage of the respective plurality $N_I$ stages.

* * * * *